United States Patent [19]

Harvey

[11] 4,311,158

[45] Jan. 19, 1982

[54] WASHER-DRYER FOR PAINT ROLLERS

[76] Inventor: Jerry J. Harvey, 4403 Louisiana, St. Louis, Mo. 63111

[21] Appl. No.: 127,555

[22] Filed: Mar. 6, 1980

[51] Int. Cl.[3] ..... B08B 3/02

[52] U.S. Cl. ..... 134/138; 134/141

[58] Field of Search ..... 134/138–139, 134/141, 149, 153, 56 R–58 R

[56] References Cited

U.S. PATENT DOCUMENTS

| | | | |
|---|---|---|---|
| 2,567,820 | 9/1951 | Messerschmidt | 134/138 |
| 2,711,748 | 6/1955 | Barsness | 134/149 |
| 2,938,368 | 5/1960 | Bixel | 134/138 X |
| 3,075,534 | 1/1963 | Habostad | 134/138 |
| 3,428,060 | 2/1969 | Spivey | 134/138 X |
| 3,471,251 | 10/1969 | Parker, Jr. | 134/138 |
| 3,577,280 | 5/1971 | George | 134/138 |
| 3,730,195 | 5/1973 | Kay | 134/138 |
| 3,818,529 | 6/1974 | Leggett | 134/138 X |
| 3,873,364 | 3/1975 | Smith | 134/138 |
| 3,886,960 | 6/1975 | Krueger | 134/138 |

FOREIGN PATENT DOCUMENTS

| | | | |
|---|---|---|---|
| 945670 | 7/1956 | Fed. Rep. of Germany | 134/141 |
| 1089794 | 11/1967 | United Kingdom | 134/58 R |

*Primary Examiner*—Robert L. Bleutge

*Attorney, Agent, or Firm*—Jerome A. Gross

[57] ABSTRACT

A washer/dryer for paint rollers comprises a bucket-like container having pivotally-mounted inside a normally horizontal paint-roller spindle-shaft assembly, including outward resilient supports of a length less than a standard paint roller, to leave the ends of a roller mounted thereon open. An elongated water manifold, fed by a diverter valve, supplies water through primary spray heads to clean the outer side of the roller, and to secondary spray heads, axially outward of the roller and directed substantially parallel to the spindle axis, for cleaning the open ends of the roller. Water is also directed by a jet nozzle onto a turbine coupled for rotation with the paint-roller support; by operation of the diverter valve, water may be supplied to at least the spray heads for washing, to only the jet nozzle for spin drying, or to neither to terminate the wash/dry cycle.

2 Claims, 4 Drawing Figures

WASHER-DRYER FOR PAINT ROLLERS

BACKGROUND OF THE INVENTION

The present invention relates to devices for cleaning paint rollers, and specifically to such devices which direct a spray of water on the roller to both spin the roller and wash the paint from it.

With the present widespread use of water-based paints, paint rollers are generally washed out with water after use, allowed to dry and then reused. Washing the rollers by hand is a time-consuming and unpleasant task, particularly in cold weather; if the roller is not carefully cleaned, it cannot be reused.

To deal with this problem, many attempts have been made to design paint roller cleaners; for example, those shown in U.S. Pat. Nos. 3,730,195 to Kay, 3,577,280 to George, 2,938,368 to Bixel, 3,075,534 to Habostad, and 3,472,251 to Parker. In these, the paint roller is mounted by its handle into an enclosure in which a stream of water is directed substantially tangentially onto the outer surface of the roller, causing it to rotate while the paint is washed from it. U.S. Pat. No. 3,873,364 to Smith provides a sleeve upon which the paint roller, removed from its handle, is slided; this assembly is inserted through the open bottom of a housing and snapped into position so that a movable nozzle may be utilized to rotate the roller and wash the paint from it.

These tangentially-spraying prior art paint roller cleaners are not capable of cleaning off paint which may have accumulated on the inside of the roller, around the end plates. In U.S. Pat. No. 3,886,960 to Krueger, an attempt is made to clean the end plates by giving an axial slant to the outermost of the otherwise nearly tangential sprays; this is not thought to adequately clean the inside of the roller.

For best results, a recently-washed paint roller must be dried before it is re-used. This may be done by rapidly spinning the roller, as suggested in the Krueger patent, or by squeezing as in the construction in U.S. Pat. No. 3,818,529 to Leggett.

SUMMARY OF THE INVENTION

An object of the present invention is to provide a device for washing paint rollers which actively operates to dry the rollers after washing is complete. Another object is to provide such a paint roller washing device which operates to wash the inside of the roller as well as the outside.

Briefly described, the present invention is a device for cleaning hollow paint rollers which comprises an enclosure having an upper access opening and including a paint roller spindle-shaft assembly mounted to its side wall for upward pivoting, and with radially-outward resilient supports, of a length less than the axial length of a standard paint roller. By so pivoting the spindle-shaft assembly, a roller may be mounted on the spindle-shaft resilient supports through the upper access opening of the enclosure. The enclosure further contains an elongated water spray head manifold, radially outward of the spindle, to clean the outer side of the roller, and secondary water spray heads, axially outward of the roller and directed substantially parallel to the spindle axis, to clean the inner side of the roller.

A jet nozzle directs a stream of water on a turbine adjacent and coupled to the resilient supports on which the paint roller is mounted; by utilizing a diverter valve to supply water selectively only to this jet nozzle, the roller may be spun dry after washing has been completed.

DESCRIPTION OF THE PREFERRED EMBODIMENT

Figure 1:
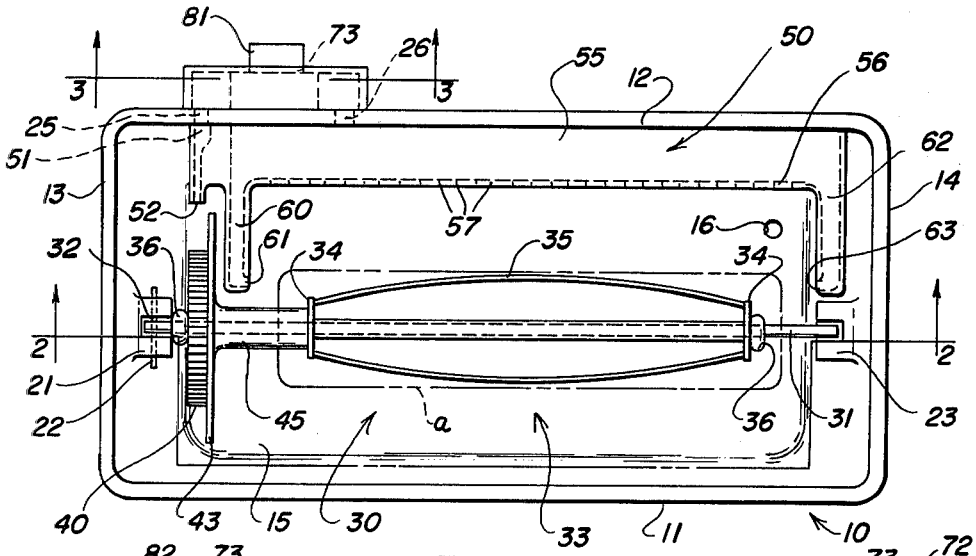
FIG. 1 is a plan view of a preferred embodiment of the present invention, showing a paint roller in phantom lines slided onto a paint-roller spindle-shaft assembly within a bucket-like container.

The present invention, as embodied in the device described below, is useful for cleaning and drying hollow cylindrical paint rollers a of the type constructed of a cardboard or plastic core covered by soft material which will absorb paint and deposit it upon the surface to be painted. Such paint rollers a are manufactured in fixed standard lengths and diameters; the preferred embodiment of the present invention is best suited for use with standard rollers of nine-inch length.

Described in detail, the preferred embodiment of the present invention includes a rectangular bucket-like enclosure or container 10 having a front side wall 11, rear side wall 12, left side wall 13, right side wall 14, and a bottom wall 15 with a drain hole 16. The container 10 has an open upper side for access purposes, but a lid 17 with a handle is provided to cover the upper access opening during the washing and drying cycle.

The inner side of the left side wall 13 is provided with a pair of side-by-side vertical left side support lugs 21 which support between them a horizontal fore-to-aft pivot pin 22, while the opposite right side wall 14 has a corresponding pair of right side support lugs 23, joined by a support saddle portion 24 but without the inclusion of a pivot pin. The support lugs 21, 23 are utilized to support horizontally between them a paint-roller spindle-shaft assembly, generally designated 30 and described in detail below. The rear side wall 12 has a pair of horizontally-spaced-apart bores substantially at the level of the support lugs 21, 23, hereafter referred to as the left rear wall bore 25 and the right rear wall bore 26.

The paint-roller spindle-shaft assembly 30, referred to above, is comprised of a shaft 31 having a diametral bore 32 at one of its ends by which it is mounted to the horizontal pivot pin 22 of the left side support lugs 21 and from which it extends to the right side support lugs 23, on whose saddle portion 24 its free end is normally supported. It may be preferable for the right support lugs 23 to include means to latch the shaft 31 in such normal supported position. The shaft 31 supports for rotation a substantially conventional resilient paint-roller support 33, forming a radially outer portion of the spindle-shaft assembly, made up of a pair of circular end plates 34 spaced apart approximately seven inches and joined by a plurality of arch-like springy support members 35 which provide a radially resilient support upon which a paint roller a may be slided. The resiliency of the support members 35 allows the roller a to be slided into place, and prevents its axial movement once so mounted. The shaft 31 supports for rotation on its end adjacent to the pivot pin 22 a water turbine 40 having a plurality of angularly-projecting vanes such that a stream of water projected from outward of the turbine circumference will cause it to rotate. The water turbine 40 has, on its side opposite the pivot pin 22, an integral splash guard 43 of sufficient radial extent to prevent water directed upon the turbine 40 from being splashed onto the adjacent-mounted paint roller a. An axial spacer 45 fixedly joins the water turbine splash guard 43 to the adjacent-most roller support end plate 34, whereby rotation of the water turbine 40 rotates the paint roller support 33. A pair of radial projections 36 are provided on the shaft 31 axially outward of the right side end plate 34 and the water turbine 40, to prevent axial movement of the rotatable assembly relative to the shaft 31.

For use in directing water to the turbine 40 and onto the paint roller a, the preferred embodiment is provided with a water manifold, generally designated 50, mounted on the inner side of the container 10 along its rear and right side walls 12, 14, extending generally from the water turbine 40 on the rear side wall 12 to the support lugs 23 on the right side wall 14. The water manifold 50 includes a turbine supply portion 51 which serves as a conduit for water flow from the left rear wall bore 25 to a jet nozzle 52 radially outward of and directed downward toward the lower rear side of the water turbine 40.

Separated from the turbine supply portion 51, the water manifold 50 has a spray head portion 55 having, on its rear side, an elongated channel 56 extending from adjacent to the turbine supply portion 51 nearly to the right side wall 14. An enclosed chamber is thus formed by mounting of the manifold 50 to the rear wall 12; the channel 56 receives water flow via the right rear wall bore 26 and delivers the water through spray orifices 57 directed generally toward the paint-roller support 33, as shown in FIG. 1, serving as first or primary water spray head means. In the preferred embodiment, the orifices 57 are so directed as to spray water substantially tangentially onto the lower rear side of the outer surface of a paint roller a mounted onto its support 33. In an alternative embodiment, the orifices 57 may be directed radially toward the axis of the spindle-shaft assembly 30, where it may be deemed advantageous to penetrate deeply into the soft outer layer of the roller a.

The spray head portion 55 of the manifold 50 is further provided with secondary water spray head means made up of a pair of duct members, including a left duct member 60 projecting inward toward the interior of the container 10 from the elongated channel 56 to end immediately to the right of the water turbine splash guard 43, to the rear of the axial spacer 45 and substantially to the left of the paint roller support 33, whereby to accommodate a paint roller a mounted on the support 33. At its end, the left duct member 60 has a spray orifice 61 generally parallel with or directed substantially along the axis of the paint-roller spindle-shaft assembly 30 so as to spray water to the right into the end of a hollow paint roller a so mounted. The secondary water spray head means further includes a right duct member 62 extending from the elongated channel 56 along the right container wall 14, ending at the right support lugs 23, and likewise having a substantially axially-directed spray orifice 63, whereby to direct a water spray leftward within the hollow paint roller a.

Figure 3:
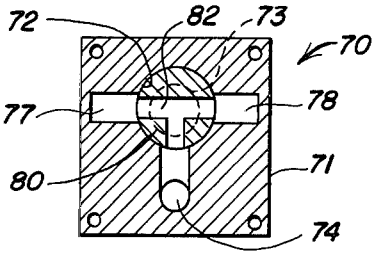
FIG. 3 is a sectional view, taken along line 3—3 of FIG. 1, showing a diverter valve rotated to selectively supply water for spinning the paint roller and washing it.

To supply water to the manifold 50 for carrying out the cleaning and drying cycles, a diverter valve, generally designated 70 and shown in section in FIG. 3, is mounted to the outer side of the rear wall 12, as shown in FIG. 1, to direct water selectively to either the left and right bores 25, 26 for washing, to only the left bore 25 for drying, or to neither to terminate drying. The diverter valve 70 is comprised of a housing 71 mounted by screws to the rear wall 12 and having a horizontally-extending cylindrical hollow 72 on its forward side, adjacent to the rear wall 12. A concentric journal opening 73 extends from the cylindrical hollow 72 to the outer or rear side of the housing 71, and a lower water inlet 74 on the outer side of the housing 71 leads to the lowermost edge of the circumference of the cylindrical hollow 72. The left edge of the circumference of the cylindrical hollow 72 is coupled by a left water outlet 77 to the left bore 25, spaced 90° from the lower water inlet 74, while the right edge of its circumference is connected by a right water outlet 78 to the right bore 26, being spaced 90° in the opposite sense from the lower water inlet 74. A generally cylindrical inner valve member 80 is received by the cylindrical hollow 72, and is manually rotatable by a integral valve handle 81 which extends through the journal opening 73. The forward side of the inner valve member 80, opposite the handle 81 and adjacent to the container rear wall 12, is provided with a T-shaped hollow 82, which in a first position of the valve member 80, connects the lower water inlet 74, left water outlet 77, and right water outlet 78. As will be apparent from FIG. 3, by rotation of the valve handle 81 to a second position, shown in FIG. 4, the water entering by the lower water inlet 74 may be directed only to the left water outlet 77, or by rotation to a third shut-off position (not shown), water will not be supplied to either of the outlets 77, 78. Thus, water may be supplied selectively to at least both of the primary and secondary water spray head means, as well as to the jet nozzle 52, or to only the jet nozzle 52.

In use of the washer-dryer for paint rollers described above, to prepare a paint roller a for cleaning, the paint-roller spindle-shaft assembly 30 is pivoted upward on the horizontal pivot pin 22, to the sloping position shown by the sloping phantom axis b, its free end leaving the right side support lugs 23 and projecting through the upper access opening of the container 10, to permit the paint roller a to be slided upon the resilient paint roller support 33. The spindle-shaft assembly 30 is then pivoted downward until the free end of the shaft 31 is again supported by the right side support lugs 23 and the lid 17 is put in place. A water supply, such as via a flexible hose, is connected to the lower water inlet 74 and the valve handle 81 is rotated to the position shown in FIG. 3, such that the supplied water is directed to both the left and right outlets 77, 78 and the corresponding bores 25, 26 in the rear wall 12, to enter both supply portions 51, 55 of the manifold 50. Water entering the manifold turbine supply portion 51 is directed in a narrow jet through the nozzle 52 to impinge substantially tangentially onto the lower rear side of the turbine 40, to actively spin the turbine 40, its integral splash guard 43, and the paint-roller support 33 with its paint roller a mounted thereon. In the embodiment illustrated, the direction of rotation of these rotating elements, including the paint roller a, is thus clockwise when viewed from the right or free end of the shaft 31. Water entering the spray head portion 55 is directed through its spray orifices 57 onto the paint roller a, to wash the paint from it. In the preferred embodiment, the water directed from these spray orifices 57 strikes the roller tangentially along its lower rear side, drawing paint from the roller a and aiding its rotation. As an alternative, although the turbine is impinged tangentially, the orifices 57 may be directed radially toward the center or axis of the spindle-shaft assembly 30, so that the water strikes the paint roller at a substantially 90° angle. This may in some cases more thoroughly clean the paint roller.

Water entering the spray head portion 55 is also delivered to the left and right duct members 60, 62 from which it is sprayed axially into both ends of the hollow cylindrical paint roller a. Any paint which has accumulated within the inner side of the roller is thus washed away; if not removed, this paint might mix with the new fresh paint when the roller is next used, with serious results if the two colors are different.

The device is operated in this manner until the roller is clean. If it is desired to use the roller immediately, it is then preferable that it be dried substantially so as not to alter the color of the paint or otherwise make painting more difficult.

Figure 4:
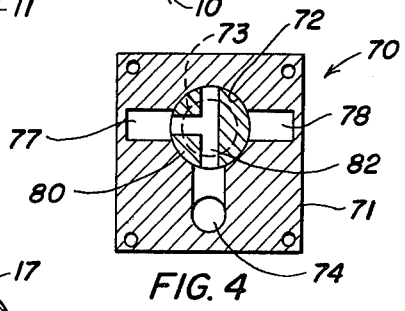
FIG. 4 is a view, similar to FIG. 3, showing the diverter valve rotated to supply water for spinning the roller to dry it.
Figure 2:
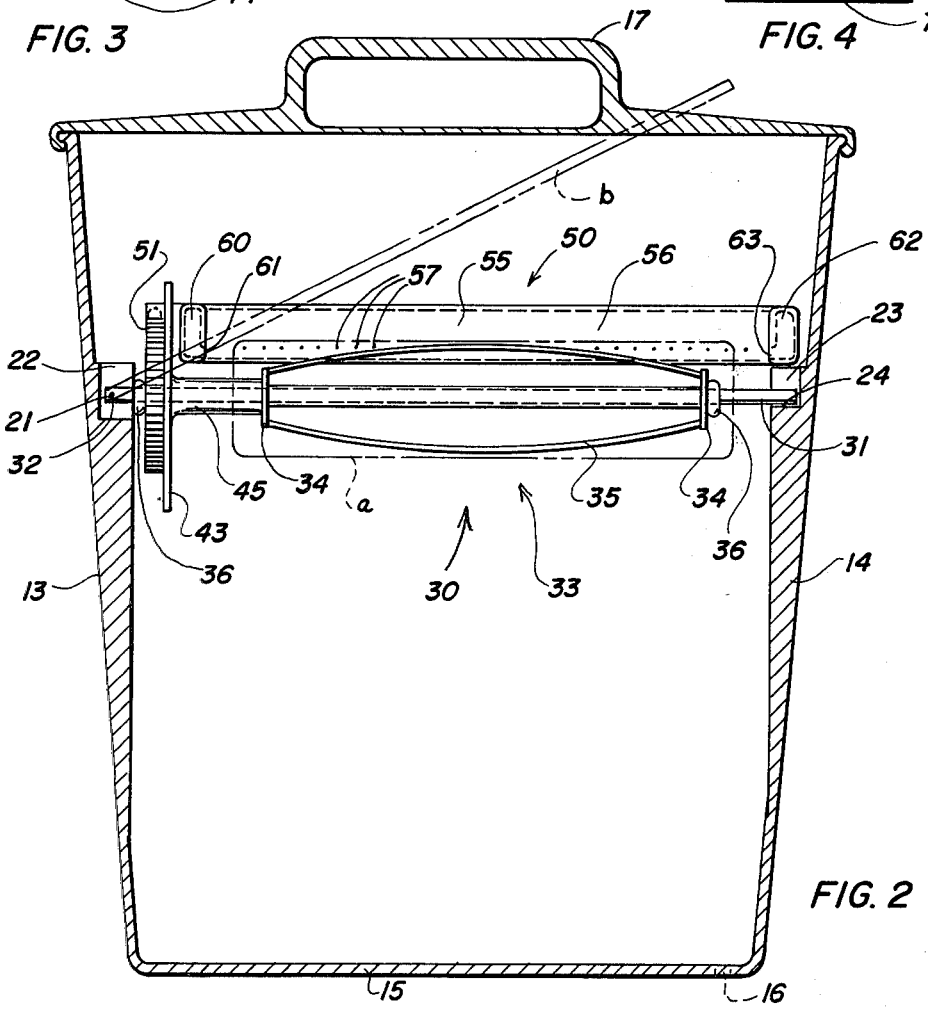
FIG. 2 is a sectional view of the preferred embodiment of the present invention taken along lines 2—2 of FIG. 1, showing the container covered by a lid.

In order to effect drying, the valve handle 81 is rotated 90° to the position shown in FIG. 4, so that the lower water inlet 74 is connected only to the left water outlet 77 and no water enters the right water outlet 78. Thus, no water is directed to the spray head portion 55, while water continues to be directed to the turbine supply portion 51 and onto the turbine 40 via the jet nozzle 52. The paint roller support 33 thus spins rapidly, the centrifugal force throwing the water from the roller a. By this construction, water, conventionally utilized for washing of the roller a is also utilized to effect drying of the roller a.

When the roller has sufficiently dried, the water spray into the turbine supply portion 51 may be halted and the drying cycle thereby terminated by rotating the diverter valve handle 81 an additional 90° to a position now shown, such that the lower water inlet 74 is not connected to either the left or right water outlet 77, 78. This permits removing the lid 17 and sliding off the paint roller without discontinuing the water supply to the valve 70. Thus, a second roller may be cleaned and dried by repeating the process, without turning off the water supply.

It will be apparent that by rotation of the diverter valve to another position, not shown, the water striking the roller may serve as the only force rotating it on washing. This may be desirable where water is not plentiful.

In a contemplated alternative embodiment, an automatic timer is provided to operate the diverter valve 70. This would enable the workman to increase his effective painting time, because he could then leave the washer/dryer to automatically clean and dry the roller as he went to lunch or at the end of the day. A significant increase in productivity is thereby achieved. From this example other modifications to the described embodiment will suggest themselves.

I claim:

1. A device for cleaning hollow tubular paint rollers of a fixed length, comprising:

an enclosure, a paint-roller rotatable spindle-shaft assembly mounted within the enclosure and having paint roller support means on its radially outer portion, the axial extent of said paint roller support means being less than the fixed length of such a roller, whereby the ends of such a roller mounted thereon are left open, together with first water spray head means, positioned radially outward of the spindle-shaft assembly, whereby to wash such roller outer surface, and second water spray head means, positioned axially outward of both ends of the spindle and directed substantially parallel to the axis of the spindle, whereby to spray water into the ends of such roller, further comprising a water turbine adjacent to one end of said paint roller support means, means coupling the water turbine to said paint roller support means, jet nozzle means to direct a stream of water on the turbine, and diverter valve means for supplying water selectively to both said first and second water spray head means or to only said jet nozzle means, whereby operation of said diverter valve means may first wash such paint roller and then spin dry it.

2. The device defined in claim 1, wherein said first water spray head means is characterized in directing its stream of water radially toward the axis of the spindle-shaft assembly, and wherein said diverter valve means, in supplying water selectively to at least both said first and second water spray head means, further supplies water to said jet nozzle means, whereby to actively spin the roller while washing.

* * * * *